United States Patent [19]

Senor et al.

[11] 3,936,792

[45] Feb. 3, 1976

[54] CIRCUIT BREAKER APPARATUS

[75] Inventors: Ronald E. Senor, Norton, Mass.; George Trenkler, East Providence, R.I.

[73] Assignee: Texas Instruments Incorporated, Dallas, Tex.

[22] Filed: Apr. 10, 1974

[21] Appl. No.: 459,527

Related U.S. Application Data

[62] Division of Ser. No. 302,158, Oct. 30, 1972, Pat. No. 3,818,404.

[52] U.S. Cl. ..... 337/85; 337/349

[51] Int. Cl.[2] ..... H01H 61/04

[58] Field of Search ..... 337/67, 85, 95, 349, 354, 337/89, 111, 112; 200/241, 242, 251

[56] References Cited

UNITED STATES PATENTS

| | | | |
|---|---|---|---|
| 2,440,937 | 5/1948 | Emigh | 337/85 X |
| 2,597,759 | 5/1952 | Starkey | 337/111 X |
| 3,033,958 | 5/1962 | Wells et al. | 337/85 X |
| 3,577,111 | 5/1971 | Nardulli | 337/89 |
| 3,609,618 | 9/1971 | Wells | 337/95 |
| 3,609,620 | 9/1971 | Lee | 337/112 X |

*Primary Examiner*—G. Harris

*Attorney, Agent, or Firm*—John A. Haug; James P. McAndrews; Russell E. Baumann

[57] ABSTRACT

A circuit breaker device which is particularly useful with direct current such as in an automotive application comprises a main creep-acting thermostatic strip member mounted on a second auxiliary U-shaped thermostatic member, the U-shaped member being attached to the strip with the high and low expansion layers being dissimilar or reversed in order to obtain increased contact force prior to actuation and faster contact opening and in effect, greater differential after actuation. One leg of the U-shaped thermostatic member is mounted on a base plate, the other leg cantilever mounts the thermostatic strip. A contact is located on the free distal end of the thermostatic strip and is adapted to move into and out of engagement with a stationary contact supported on the base plate but electrically insulated therefrom. A special insulator pad mounts the stationary contact and is received on and locked in place on the base plate.

6 Claims, 12 Drawing Figures

CIRCUIT BREAKER APPARATUS

Divisional of pending prior application Ser. No. 302,158 filed on Oct. 30, 1972, now U.S. Pat. No. 3,818,404.

This invention relates to circuit breaker devices and more particularly to a circuit breaker especially useful in automotive type direct current applications. There are many automotive power applications ranging from low amperage requirements, for example, 17 to 20 amperes on windshield wipers to higher amperage requirements such as 60 amperes on a seat lift which require reliable long lived circuit protection. Circuit breaker devices employing a snap-acting element are not suitable for several reasons. It is desirable to permit operation of the motor so that its intended function can be achieved, such as operating the windshield wipers, even if a fault exists but at the same time prevent overheating of the motor. With a snap-acting device it is difficult to obtain the desired differential, the life of the device is inherently more limited than a creep type and in general they are sensitive to ambient temperature variations. This invention relates to improvements in such a circuit breaker as shown in U.S. Pat. No. 2,585,068. In that patent, a circuit breaker is shown having a main bimetal of a first electrical resistance per unit of length and of a first deflection and an oppositely acting auxiliary bimetal of a second higher resistance per unit of length and shorter deflection connected thereto, the main portion being bent into a U-shape with one leg carrying the movable contact at its inner side. The opposed leg of the U-shaped bimetal is connected to an end of the auxiliary bimetal with the other end mounted upon a terminal post which serves as a heat sink for conduction of heat from the reverse portion. The auxiliary bimetal acts to increase the pressure on and maintain the contacts closed briefly upon heating above the ambient temperature. With a straight auxiliary strip bimetal and a U-shape main operating bimetal connected together in electrical and thermal conducting relation in the manner indicated, when a normal current flows through the breaker below an overload value, the auxiliary bimetal bends downwardly pressing the contacts more firmly together; however, upon heating by an overload current flow, the movements of the main operating bimetal predominate having been heated above an opening temperature. Eventually movement of the main operating bimetal causes the contacts to separate, the interruption of current flow causing a continued separating movement of the contacts toward fully open position as the auxiliary bimetal cools. However the arrangement of the main and auxiliary bimetals is such that no effective means is provided to either break any contact welds which may occur or to prevent the formation of such welds. The movement of the contact on the U-shaped main operating bimetal is in a direction generally normal to the contact face with virtually no shear force exerted between the contacts, which shear force is effective both in preventing the formation of contact welds and breaking them upon the occurrence of any. Further, the stationary contact and terminal assembly has no positive lock to prevent turning and concomitant changes in electrical separation between the assembly and the base plate.

Thus it is an object of the invention to provide a circuit breaker particularly suitable for automotive applications having wiping contact action to prevent formation of contact welds and having stationary contact and terminal structure with means to avoid turning and twisting thereof.

Briefly, a circuit breaker built in accordance with the invention employs a U-shaped auxiliary thermostatic strip having legs of approximately equal length with a straight thermostatic main strip mounted to one leg of the U-shaped member with the dissimilar coefficients of expansion adjacent one another. As the most active member, the U-shaped member, deflects, it forces the main member in a direction along its longitudinal axis causing wiping of the contacts. The stationary contact is mounted on a terminal which is received on an insulating pad, the pad in turn is mounted on the circuit breaker support plate in such a way that it is securely locked in place and has positive means to prevent turning or twisting thereof.

The invention accordingly comprises the constructions hereinafter described, the scope of the invention being indicated in the appended claims.

In the accompanying drawings in which the preferred embodiment is illustrated:

Corresponding reference characters indicate corresponding parts throughout the several views of the drawings.

Figure 6:
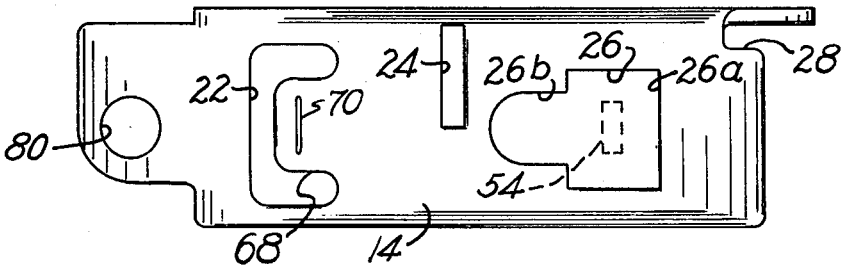
FIG. 6 is a top view of the FIG. 5 support plate.

The circuit breaker illustrated in the drawings is generally indicated by numeral 10. It comprises a bracket 12 having a base plate 14 and a depending mounting wall 16. Apertures 18 and 20 are provided in wall 16 to facilitate mounting of circuit breaker 10 as desired, as on a brush card. Plate 14, as best seen in FIG. 6, is provided with cut out portions 22, 26 and notches 24 and 28 for purposes to be explained infra.

Figure 7:
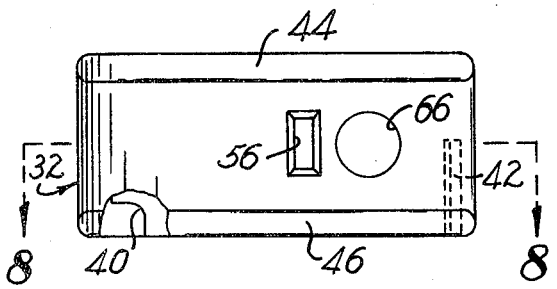
FIG. 7 is a top view of the insulating pad.
Figure 8:
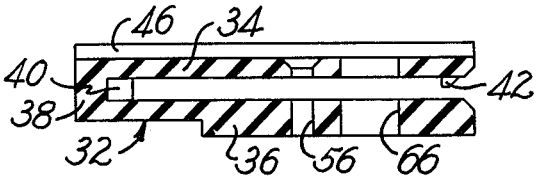
FIG. 8 is a cross section of the insulating pad taken on lines 8—8 of FIG. 7.
Figure 9:
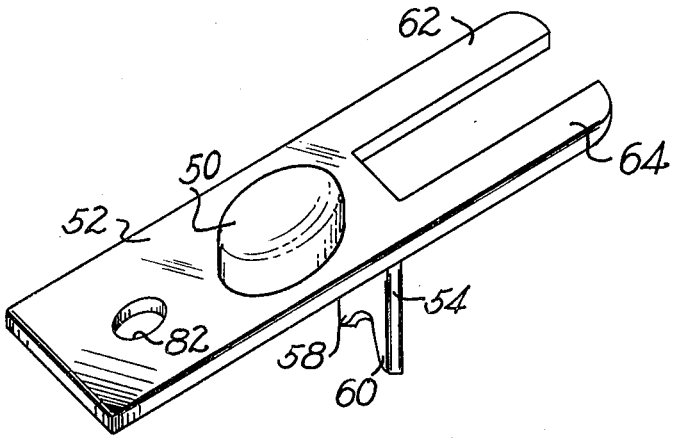
FIG. 9 is a perspective view of the stationary contact and terminal structure.
Figure 10:
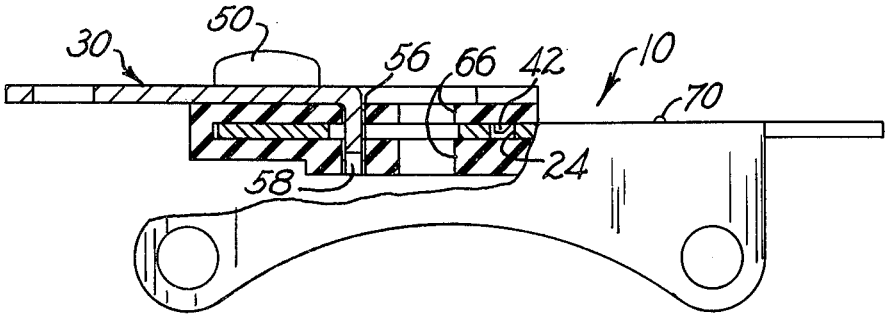
FIG. 10 is a side view of a support plate mounting the insulating pad and stationary contact and terminal structure, partly broken away and partly in cross section to show certain of the locking means employed.

Mounted on plate 14 is an insulator and stationary contact assembly 30 comprising an insulative pad 32 formed of an electrically insulated material such as a thermoset resin, having an upper platform 34 and a lower platform 36 connected by stop wall 38. Platforms 34 and 36 lie in generally parallel planes. As seen in FIGS. 7 and 8 boss 40 is formed between the upper and lower platforms adjacent stop wall 38. A lip 42 depends from upper platform 34 and extends laterally from the center to one side. Ribs 44, 46 are formed in the upper platform 34 and extend along the length thereof. Plate 14 is received between upper and lower platforms 34,36 with boss 40 of insulating member 32 received in notch 28 and lip 42 received in notch 24 to lock the insulating member in place.

Stationary contact 50 is mounted as by welding on terminal plate 52 which has an arm 54 depending downwardly therefrom. Plate 52 is received on insulating member 32 between ribs 44, 46 which maintain plate 52 in aligned position. Leg 54 is received in aligned apertures 56 of insulating pad 32 and 26*a* of plate 14 and is staked securely in place by spreading bifurcations 58, 60. As indicated in FIG. 6, aperture 26*a* is sized to provide desired electrical insulation (air space) between the plate 14 and the leg 54 (in dashed lines).

Striking leg 54 from terminal strip 52 and bending it to extend downwardly therefrom leaves arms 62, 64 which provide an elongated surface for abutment with ribs 44, 46 to provide positive maintenance of terminal plate in its proper location. The space between legs 62, 64 is aligned with aperture 26b of plate 14 and aperture 66 of insulating pad 32 for a purpose to be described below.

Tongue 68 extends into aperture 22 and is formed with a weld projection 70 for mounting of U-shaped thermostatic member such as member 72 which in turn cantilever mounts another thermostatic member such as bimetallic strip 74 as by welding as indicated at 75. Strip 74 mounts contact 76 on its free distal end portion aligned to move into and out of engagement with stationary contact 50.

U-shaped thermostatic member 72 has a high coefficient of expansion side HE located on the inside of the U-shaped bend. The high coefficient of expansion side HE of strip thermostatic member 74 faces member 72 so that dissimilar sides of the members are contiguous.

Bracket 12 is preferably formed of a weldable material such as steel which is ball peened with copper flash to minimize rust. Bimetallic strip 74, U-shaped strip 72 and bracket 12 are welded together, the insulative pad 32 is slid into position and finally terminal plate 52 is placed between ribs 44 and 46 of pad 32 with leg 54 received in aperture 56 of pad 32 and 26 of plate 14.

The circuit breaker is calibrated by inserting a rod through aperture 66 and biasing it against strip 74 with a predetermined force causing the contacts to open. Tongue 68 is then bent until the contacts close and then the rod is withdrawn with the device calibrated to that force. It should be noted that with this method of calibration that 100 percent yield can be achieved since the calibration tab can be bent in either direction. Terminal piece 52 as well as stationary contact 50 is silver plated to prevent the possibility of corrosion.

U-shaped bimetallic member 72 is chosen so that it has a higher resistivity than strip 74 so that contact pressure will increase prior to opening thereof. The U-shaped member controls mainly the on times while the strip 74 controls the no current temperature trip point. It will be noted that upon overcurrent, deflection of the more active bimetallic strip 72 causes the top blade to move to the right as viewed in FIG. 11, thus causing contact wiping. This has the advantage that even contact wear is obtained and contact welds are avoided. This is particularly important on direct current motors due to the tendency to form ionized paths between the contacts and results in better life than obtainable in the prior art.

The insulative pad is made in such a way that it snaps into place with lip 42 being received in notch 24 thus facilitating assembly of the device since the part is located in its proper position without the necessity of being separately held. Cooperating with lip 42 received in notch 24 to prevent twisting or turning of insulating pad 32 is boss 40 formed on connecting portion 38 of insulating pad 32 which is received in notch 28 of the mounting bracket. Terminal plate 52 is then placed between ribs 44 and 46 which prevents twisting of the terminal plate within the insulative pad and when bifurcations 58 and 60 are spread outwardly yet another means locks the pieces together. Aperture 66 in the pad is aligned with the space between legs 62 and 64 of terminal plate 52 and portion 26*b* of aperture 26 to provide access for the calibrating rod. Aperture portion 26*a* is formed large enough that sufficient air space is provided between plate 14 and leg 54 of terminal 52 which prevents so called high pot failures.

Holes 80 in plate 14 and 82 in terminal plate 52 are provided to facilitate electrical attachment to circuit breaker 10. The circuit breaker is normally used with bracket 12, mounted on a brush card by placing fasteners (not shown) through apertures 18 and 20 with terminal 82 connected to the card of the motor and terminal 80 connected to ground.

Circuit breaker 10 is not adversely affected by fluctuations in ambient temperature as would snap-acting devices since deflection in strip 74 is offset by an opposite deflection in member 72. That is, as temperature increases, strip 74 deflects in a direction which tends to cause contact opening; however, member 72 deflects such that the U-shaped member opens tending to straighten itself in a contact closing direction and offsets the deflection in strip 74. Actually the net movement of contact 76 mounted on the free distal end of strip 74 is slightly to the right as viewed in FIG. 11 causing a slight amount of contact wiping. As member 72 changes in temperature, point E moves along the locus identified by dashed lines AB in FIG. 11. Since a decrease in temperature will have just the opposite effect on strip 74 and member 72 it will be seen that there is continual contact wiping as ambient temperature fluctuates thereby keeping the contact surfaces clean and preventing the beginning formations of contact welds.

Figure 1:
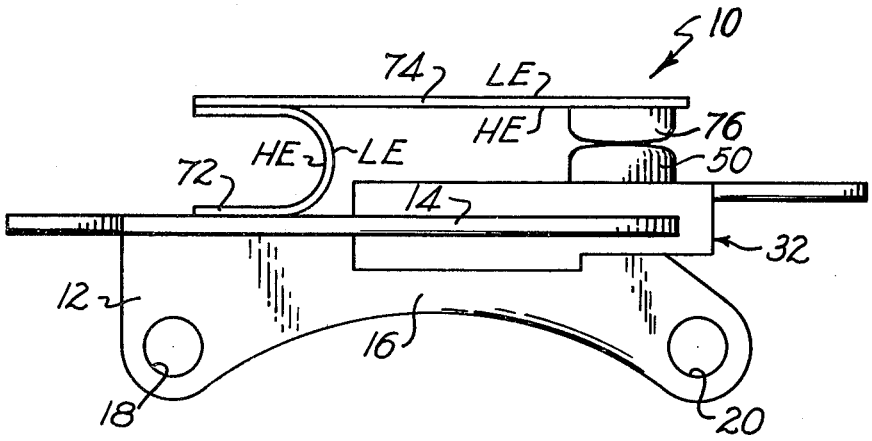
FIG. 1 is a side view of a circuit breaker made in accordance with the invention.
Figure 2:
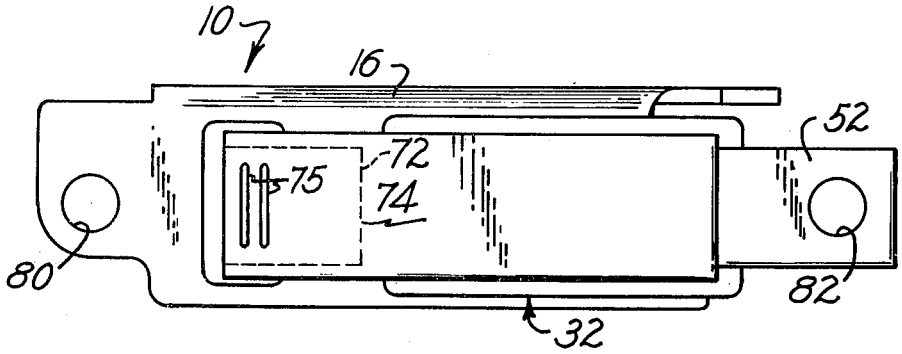
FIG. 2 is a top view of the FIG. 1 structure.
Figure 3:
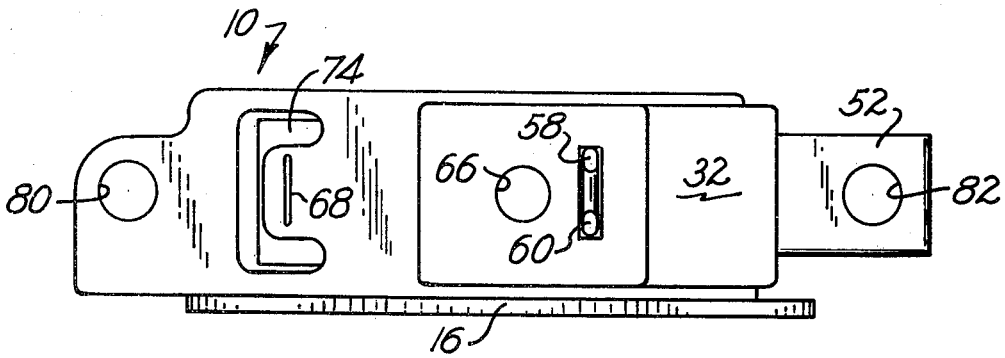
FIG. 3 is a bottom view of the FIG. 1 structure.
Figure 4:
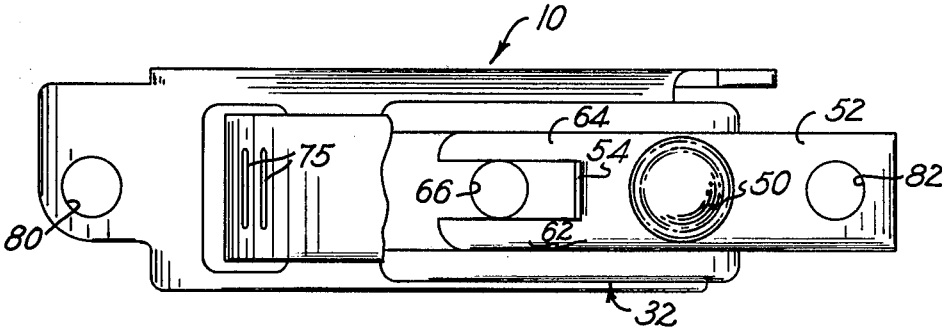
FIG. 4 is a view similar to FIG. 2 but with the auxiliary bimetallic member broken away.
Figure 5:
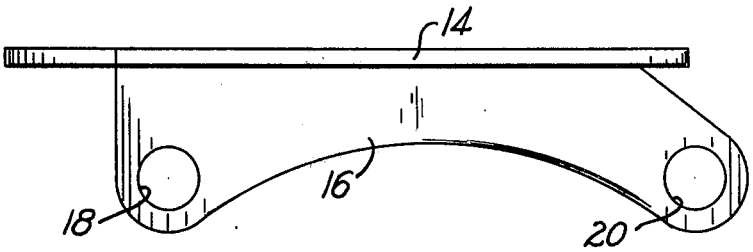
FIG. 5 is a side view of the support plate.
Figure 11:
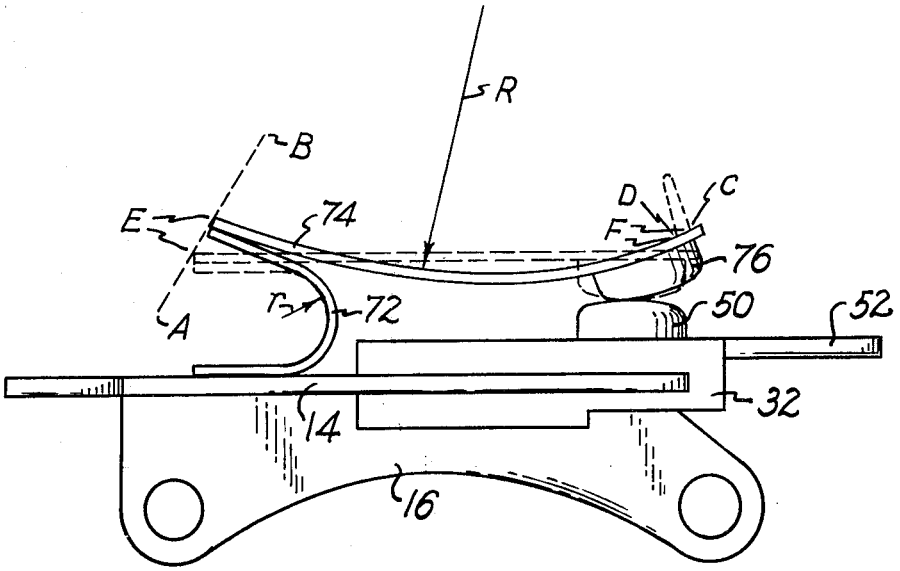
FIG. 11 is a view similar to FIG. 1 showing the thermostatic members as they appear just prior to contact opening and showing the loci of the two opposite ends of the main thermostatic members.
Figure 12:
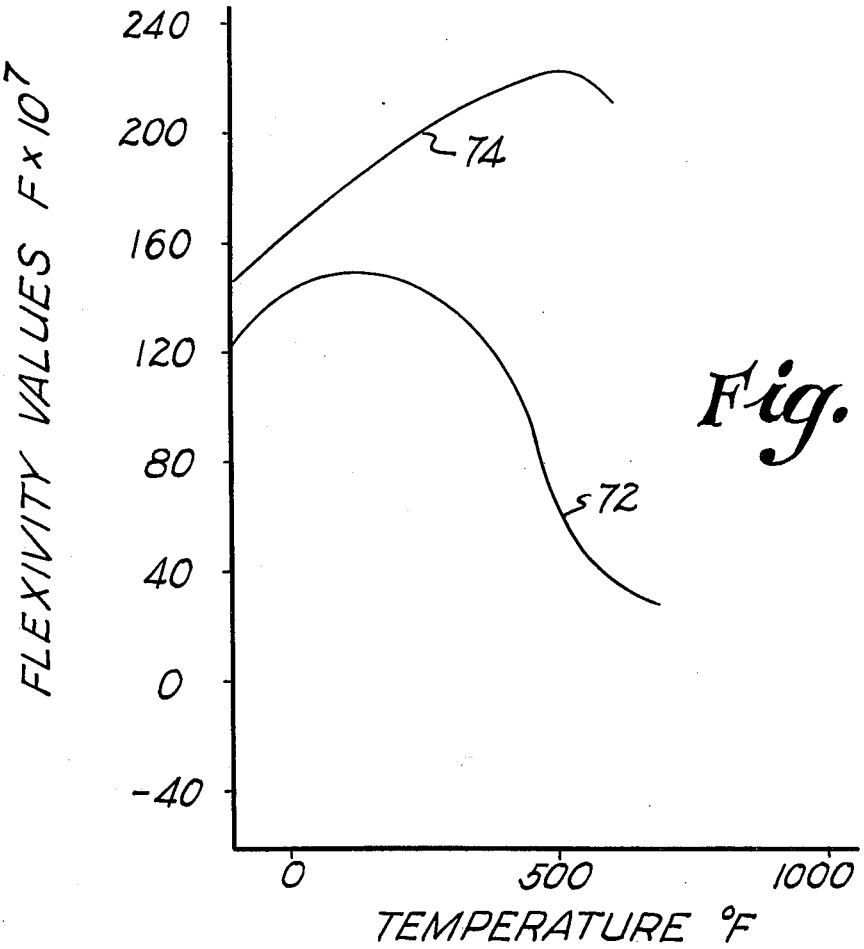
FIG. 12 is a graph showing flexivity versus temperature for two materials which can be used for the respective thermostatic members.

Member 72 is chosen so that its value of electrical resistivity is greater by approximately twice as much as for member 74. Member 72 also preferably is formed with a smaller cross section as can be observed by comparing the width of the members in FIG. 2. It will be understood that this could also be accomplished by making the thickness of member 72 less than that of member 74. The material for member 72 is also chosen having a flexivity v. temperature curve with a sharp knee, that is the flexivity decreases with increasing temperature above a predetermined temperature. Flexivity is a measure of how much a thermostat metal moves with a change in temperature and may be defined as the change in curvature of the longitudinal center line of the specimen per unit of temperature change for unit thickness. Reference may be had to FIG. 12 showing flexivity versus temperature curves for materials which can be used for members 72,74 respectively. When circuit breaker 10 is energized, auxiliary member 72 heats at a faster rate than does member 74 due to its higher value of resistivity. Thus as seen in FIG. 11, radius r of member 72 becomes larger moving member 74 and contact 76 toward the position shown in solid lines from the dashed line position. This movement causes contact 76 to slide or wipe across stationary contact 50 as well as to rock against the stationary contact. Normal current levels conducted through the breaker will cause member 72 to deflect more than strip 74 thereby causing contact 76 to move further to the right as viewed in FIG. 11 and causing an increase in contact force. Heat is conducted away from member 72 into bracket 12 and strip 74; however, a slight differential in temperature remains with member 72 maintained at a higher temperature. Eventually the auxiliary member 72 reaches a temperature at which radius r is not increasing so rapidly, that is when the slope of the flexivity versus temperature curve decreases. At the same time, member 74 is being heated with the result that radius R is decreasing. It will be seen that the rate of change in radius R of member 74 in relation to radius *r* of member 74 increases when the flexivity of member 72 begins to decrease. Upon overcurrent, eventually member 74 deflects enough to cause contact 76 to separate from contact 50. Since member 72 is of less mass than member 74, was heated to a higher temperature, and is mounted directly on plate 14 which acts as a heat sink, it cools more quickly and point E moves along its locus AB toward its original position (dashed line in FIG. 11) causing in increase in the speed of contact opening and the total distance of separation of the contacts. Dashed line CD identifies the locus of point F near the free distal end of member 74 as it moves from contact opening to contact closing.

Thus it may be seen from the above that the instant invention provides an improved cricuit breaker having longer life characteristics than the prior art due to contact wiping and improved stationary contact terminal assembly.

In view of the above, it will be seen that the several objects of the invention are achieved and other advantageous results obtained.

As various changes could be made in the above construction without departing from the scope of the invention, it is intended that all matter contained in the above description or shown in the accompanying drawings shall be interpreted as illustrative and not in a limiting sense.

We claim:

1. A switch for breaking an electric circuit upon the occurrence of a predetermined overload comprising a base, a generally U-shaped first thermostatic member having respective high and low coefficient of expansion sides and having a first value of resistivity per unit of length, the first thermostatic member having a first and second leg joined by a bight portion, the first leg extending along the surface of the base and physically attached thereto, a generally flat second thermostatic strip member having respective high and low coefficient of expansion sides and having a value of resistivity per unit of length less than that of the first thermostatic member, the second leg of the first thermostatic member extending along a portion of the second thermostatic member and physically attached thereto with the sides contacting each other of dissimilar coefficient of expansion, a stationary contact mounted on the base electrically separated from the first and second thermostatic members, a movable contact mounted on the second thermostatic member and adapted to move into and out of engagement with the stationary contact, and means to provide electrical connection to the thermostatic members and the stationary contact whereby heating of the first thermostatic member causes increased contact force and contact wiping until deflection of the second thermostatic member causes separation of the contacts.

2. A switch according to claim 1 in which the second thermostatic member extends from the free end of the second leg toward and beyond the bight portion, the high coefficient expansion side of the first thermostatic member being on the inside so that the low coefficient of expansion side of the first thermostatic member is in contact with the high coefficient of expansion side of the second thermostatic member.

3. A switch according to claim 1 in which a tongue is formed in the base, the first leg of the first thermostatic member being joined to the tongue whereby contact pressure can be adjusted by bending of the tongue.

4. A switch according to claim 3 in which the base is an electrically conductive plate, an electrically insulative pad is lockingly received on the plate, the stationary contact is mounted on the pad, an aperture is formed in the plate and the pad so that a calibration rod can be inserted therethrough from beneath the plate to the second thermostatic member.

5. A switch according to claim 1 in which the first thermostatic member has a flexivity versus temperature curve in which flexivity decreases with increasing temperature above a predetermined temperature.

6. A switch according to claim 2 in which the second thermostatic member has a flexivity versus temperature curve in which flexivity increases with increasing temperature above the predetermined temperature.

* * * * *